United States Patent [19]

Jones

[11] Patent Number: 4,856,967

[45] Date of Patent: Aug. 15, 1989

[54] HYBRID HIGH PRESSURE PUMP FOR GAS-LIQUID PERMEAMETERS

[76] Inventor: Stanley C. Jones, 875 Front Range Rd., Littleton, Colo. 80120

[21] Appl. No.: 102,513

[22] Filed: Sep. 29, 1987

[51] Int. Cl.[4] ..... F04B 17/00

[52] U.S. Cl. ..... 417/342; 417/374; 417/401; 73/153

[58] Field of Search ..... 417/338, 339, 342, 374, 417/401, 415, 419, 344, 346, 377; 73/153; 92/2, 31, 134; 60/547.1, 579

[56] References Cited

U.S. PATENT DOCUMENTS

| | | | |
|---|---|---|---|
| 1,513,422 | 10/1924 | Raymond | 92/113 |
| 1,636,614 | 7/1927 | Prellwitz | 92/255 |
| 1,816,403 | 7/1931 | Schaer | 417/342 |
| 2,724,963 | 11/1955 | Ten Brink | 73/38 |
| 2,737,804 | 3/1956 | Herzog et al. | 73/38 |
| 3,070,023 | 12/1962 | Glasgow | 103/51 |
| 3,234,882 | 2/1966 | Douglas et al. | 417/53 |
| 3,481,587 | 12/1969 | Ruhnau | 259/98 |
| 3,502,001 | 3/1970 | Moore | 91/49 |
| 3,731,530 | 5/1973 | Tanguy et al. | 73/153 |
| 3,825,122 | 7/1974 | Taylor | 417/377 X |
| 4,083,228 | 4/1978 | Turner et al. | 73/32 R |
| 4,441,862 | 4/1984 | Vogel | 417/374 X |
| 4,457,210 | 7/1984 | Pauliukonis | 91/355 |
| 4,470,771 | 9/1984 | Hall et al. | 417/342 |
| 4,490,096 | 12/1984 | Box | 417/342 |
| 4,555,220 | 11/1985 | Hall et al. | 417/342 |

*Primary Examiner*—Leonard E. Smith
*Assistant Examiner*—Leonard P. Walnoha
*Attorney, Agent, or Firm*—Jack L. Hummel; Rodney F. Brown

[57] ABSTRACT

A fluid pump for delivering accurate volumes of high-pressure fluids is obtained using an intensifier to supply the majority of the motive power required to displace the fluids. The intensifier balances the forces between the output pressure of the displaced fluid (above a convention drive piston) with a large diameter booster piston that is driven pneumatically by low-pressure gas. A small horsepower motor provides needed power to overcome the friction of the high pressure gas pump, the differential pressure needed for the use of the pump, and to accurately control or trim the high-pressure output or rate to a precise value. A ball screw and spur gears are used to transmit the power. The pump is uniquely designed to reduce the stress from the motor to the components.

12 Claims, 6 Drawing Sheets

GAS
LIQUID
ΔP
LC
LB
LA
GC
GB
GA
LIQUID VALVES
GAS VALVES
780

HYBRID HIGH PRESSURE PUMP FOR GAS-LIQUID PERMEAMETERS

BACKGROUND OF THE INVENTION

1. Field of Art

The present invention relates to high pressure fluid pumps wherein the pump essentially includes a motor-driven piston for producing high pressure fluid outputs. The present invention more particularly relates to a high pressure fluid pump used in a gas-liquid relative permeameter incorporating a low horse power motor to provide additive motive power and incorporating a stress intensifier in the form of a booster piston to provide the majority motive power.

2. Discussion of Prior Art Results

Conventional gas-liquid relative permeameters in the analysis of oil field core samples require low-pressure delivery of gas in the range of a few psig to several hundred psig. There is a need to deliver high pressure gas to such core samples in order to more closely simulate the high underground pressures that occur in reservoirs from which the samples are taken. To deliver such high pressures, a large horse power such in the range of 0.75 Hp to 2 Hp is required to drive a pump wherein the piston in the pump displaces the gas from a chamber between the piston and the cylinder of the pump at rates of 25 to 500 $cm^3$/min at the desired level of high pressure in a range of 500 to 7,000 psig. Such large horse power motors are expensive, occupy a large amount of space and generate environmental heat and noise. In addition, the high torque required to drive the piston causes significant wear to the costly ball screw interconnecting the piston with the motor. As a result, such high pressure permeameters are not conventionally available.

Therefore, this invention provides a new range of low power gas-liquid permeameters that simulates the high pressure reservoir conditions. Such "new-range" gas-liquid relative permeameters require the delivery and recirculation of high pressure gases and liquids. Although the delivery pressure is high, the differential pressure across a reservoir rock sample being tested (a core plug) is normally quite small. To illustrate: under the teachings of the present invention, gas and/or liquids may be delivered to a core plug at a pressure of 7000 psig. However, the pressure loss suffered by these fluids as they pass through the core plug may only be 50 psi; hence, they exit the sample at a pressure of 6950 psig. Suppose that the fluid being circulated is a gas. In a gas recirculating system with a conventional pump, the energy from the high pressure exit gas is wasted; i.e., even though it tends to cause the piston in the receiving pump to be pushed back (retreated), this force is resisted by an electric motor attached to the receiving pump. In the embodiment of the present invention, however, some of the energy of the exiting gas is captured, and is used to help drive the advancing piston in the delivery pump. The electric motors in the pumps of the present invention are required to supply energy only to overcome the aforesaid differential pressures plus the friction in the pumps. Because only the relatively small differential pressure is involved, instead of the total system pressure, the power output required of the motors is considerably reduced.

Prior to the filing of the present application, a search was conducted. The results of the search are:

| Inventor | U.S. Pat. No. | Issued |
|---|---|---|
| Raymond | 1,513,422 | 10-28-24 |
| Prellwitz | 1,636,614 | 7-19-27 |
| Brink | 2,724,963 | 11-29-55 |
| Glasgow | 3,070,023 | 12-25-62 |
| Moore | 3,502,001 | 3-24-70 |
| Turner et al. | 4,083,228 | 4-11-78 |
| Pauliukonis | 4,457,210 | 7-3-84 |

The 1978 patent to Turner (U.S. Pat. No. 4,083,228) relates to a gas comparison pycnometer for accurately determining the volume of a condensed material sample. Turner utilizes two substantially equal but variable volume gas containing chambers—one as a sample chamber and one as a reference chamber. In the sample chamber is placed a volume compensation piston driven by a micrometer. The volume compensation piston is adjusted into the sample chamber by a micrometer thereby increasing the volume of the sample receiving chamber in order to maintain the equal free space volume between the sample chamber and the reference chamber. This provides a highly accurate determination of the sample volume.

The 1955 patent to Brink (U.S. Pat. No. 2,724,963) sets forth a positive displacement mercury volumetric pump driven by an adjustable-constant speed drive to permit continual displacement of mercury at a selectable flow rate, into a core holder holding a core sample from a sub-surface oil bearing reservoir.

The 1984 patent to Pauliukonis (U.S. Letters Pat. No. 4,457,210) discloses an energy conserving air motor capable of converting linear motion into rotary motion. To accomplish this, Pauliukonis utilizes a unitary piston design having a large diameter end and a small diameter end with a pathway through the center of the piston for delivering the air to the opposing pistons. Air is delivered behind the smaller diameter piston to drive the piston and to generate rotary work output. When fully driven, the air is delivered through the pathway in the center of the piston to penetrate behind the larger diameter piston thereby causing the larger diameter piston to return the piston to the working position.

The 1970 patent to Moore (U.S. Pat. No. 3,502,001) sets forth a fluid operated cylinder which is adapted to sense whether or not a load requires work. In the event that a load requires work, the valve within the piston is closed and the cylinder operates to engage the work piece and provide a work stroke. In the event that no load is present, the valve remains open and the working fluid is delivered from one side of the piston to the other side.

The 1962 patent to Glasgow (U.S. Pat. No. 3,070,023) relates to a fluid operated pump capable of pumping fluids under relatively high pressures utilizing a low or intermediately pressurized fluid as the source of motive power. Hence, a low pressure motive fluid is delivered to a larger diameter piston to drive he lower diameter piston thereby pumping the working fluid at a magnitude of several thousands pounds per square inch.

The 1924 patent to Raymond (U.S. Pat. No. 1,513,422) is essentially an air compressor for providing higher and lower air pressure outputs based upon utilizing two interconnected pistons of different diameters. The larger diameter piston provides the standard compression for air whereas the second piston of smaller diameter provides the higher pressures.

The 1927 patent to Prellwitz (U.S. Pat. No. 1,636,614) like Raymond, provides a multi-stage compressor for providing a variety of pressure ranges based upon differing sized pistons.

None of the above references disclose the features of the hybrid high pressure fluid pump of the present invention which is particularly adapted for gas-liquid relative permeability tests.

SUMMARY OF THE INVENTION

The problem to be solved in designing a fluid pump for a gas-liquid relative permeameter or for any other fluid pump for delivering accurate volumes of high pressure fluids such as gas or liquids that are driven by a large horse power motor is to eliminate the large horse power motor as the sole motive source for the circulation of the high pressure fluid thereby reducing the cost of the motor, the environmental heat and noise produced by the motor and the space required by the motor. The use of a large, conventional horse power motor requires that other components such as the ball screw and spur gears connected to the motor also be of heavy duty construction. Such components such as the ball screw, however, do not have a long life due to the high stresses involved during delivery of the motive power.

The present invention provides a solution for this problem by providing an intensifier that supplies the majority of the motive power required to displace high pressure fluids by balancing forces from the output pressure of the displaced fluid above a conventional drive piston, with a large diameter booster piston that is driven pneumatically by a low pressure gas. The intensifier provides the majority of the force to the drive piston. Under the teachings of the present invention, a small horse power motor provides the remaining amount of motive power (1) to overcome the friction of the hybrid, high-pressure gas pump of the present invention, (2) to overcome the differential pressure across the core sample and (3) to accurately control or trim the high pressure output or rate to a precise value. In addition, the components such as the ball screw and spur gears are not as heavy duty as the conventional design and exhibit increased life times due to the lower stress on the components from the lower powered motor. Under the teachings of the present invention, the intensifier provides a high compressional axial stress to the ball screw shaft thereby greatly reducing the drive stress from the motor on the races and balls of the screw. Reducing the race stress by one-half causes the ball screw to wear about eight times longer over the aforesaid conventional system.

Within the teachings of this invention, two or three such hybrid pumps are used in conjunction with each other to circulate each separate fluid (e.g., gas, water, and/or oil). For example, if two such pumps are used to circulate gas in a relative permeability test, then the second hybrid pump assembly receives gas that exits from a core sample while the first hybrid pump delivers gas to the sample. The exiting gas is at nearly as high pressure as the gas being delivered to the sample, e.g., 6950 psig versus 7000 psig. This high pressure exiting gas pushes on the high pressure piston of the second hybrid pump. The force is transmitted from the high pressure piston to the shaft of the ball screw, and therefrom to the larger-diameter booster piston.

The gas pressure below the booster piston is such that this pressure when multiplied by the area of the booster piston is exactly equal to the pressure of the high-pressure gas that exits from the core sample—when multiplied by the area of the high pressure piston—i.e., the downward force caused by the high-pressure, exiting gas is balanced by the upward force on the booster piston from the low-pressure booster gas. The stepper motor that drives the high-pressure drive piston, ball screw, and booster piston assembly downward, needs to overcome only the frictional forces in this hybrid pump. The opposing forces from the high-pressure exiting gas and the low-pressure booster gas, cause a high compressional stress on the pistons and on the shaft of the ball screw, but not on the "threads" (races) of the ball screw as found in the conventional approach described above. This increases the wear life of the ball screw.

As the stepper motor drives the assembly downward in the receiving pump, booster gas is displaced from the booster cylinder—into the booster cylinder of the delivering pump. Because the pressure of the gas being delivered to the core sample from the delivering hybrid pump is higher than the pressure of the gas exiting from said sample, the booster gas which is displaced into the delivering hybrid pump assembly is not quite high enough pressure so that its force on the booster piston balances the force on the high-pressure piston from the delivered gas. Thus the stepper motor in the delivering hybrid pump must deliver enough force to overcome the pressure difference between the delivered, high-pressure gas and the exiting high-pressure gas from the core sample, as well as the frictional forces in the pump.

DETAILED DESCRIPTION

Figure 1:
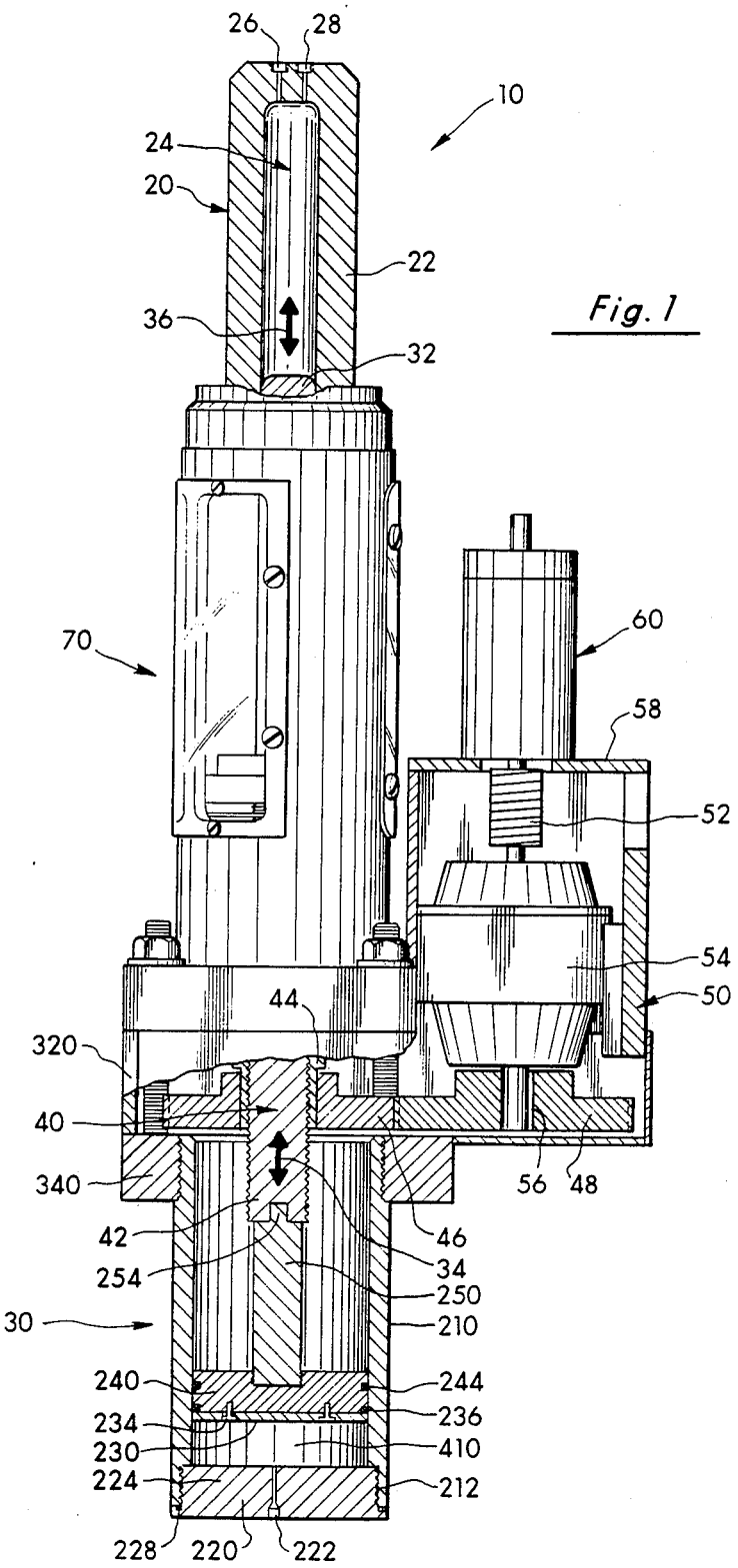
FIG. 1 is a cross-sectional view of the hybrid pump assembly of the present invention.

In FIG. 1, the hybrid pump assembly 10 of the present invention is set forth to include an upper drive piston assembly 20, a booster piston assembly 30, a ball nut and screw assembly 40, a gear reducer 54, a stepper motor 60. The upper drive piston 20 and the ball nut and screw assembly 40 are part of pump 70. Each of these assemblies will be discussed in the following.

1. Upper Drive Piston Assembly 20—The details of the upper drive piston assembly 20 are shown in FIG. 1. The upper drive piston assembly 20 includes an upper cylinder 22 of pump 70 having an inner formed chamber 24 centrally disposed therein. The upper end of cylinder 22 has two formed ports 26 and 28. Fluid port 26 is connected to a pressure transducer, not shown, which measures the pressure of the fluid contained in chamber 24. Fluid port 28 provides communication between a flow line, not shown, and chamber 24 and serves to deliver the pressurized fluid generated by the hybrid pump assembly of the present invention out from the pump. As will be discussed later, the fluid is also received through port 28. A piston 32 is driven in the cylinder 22 to displace the fluid for delivery through port 28. The upper drive piston assembly is conventionally interconnected with pump 70 which serves to connect the piston 32 with the ball screw 40. The fluid delivered through ports 26 and 28 may be a gas or liquid.

Figure 2:
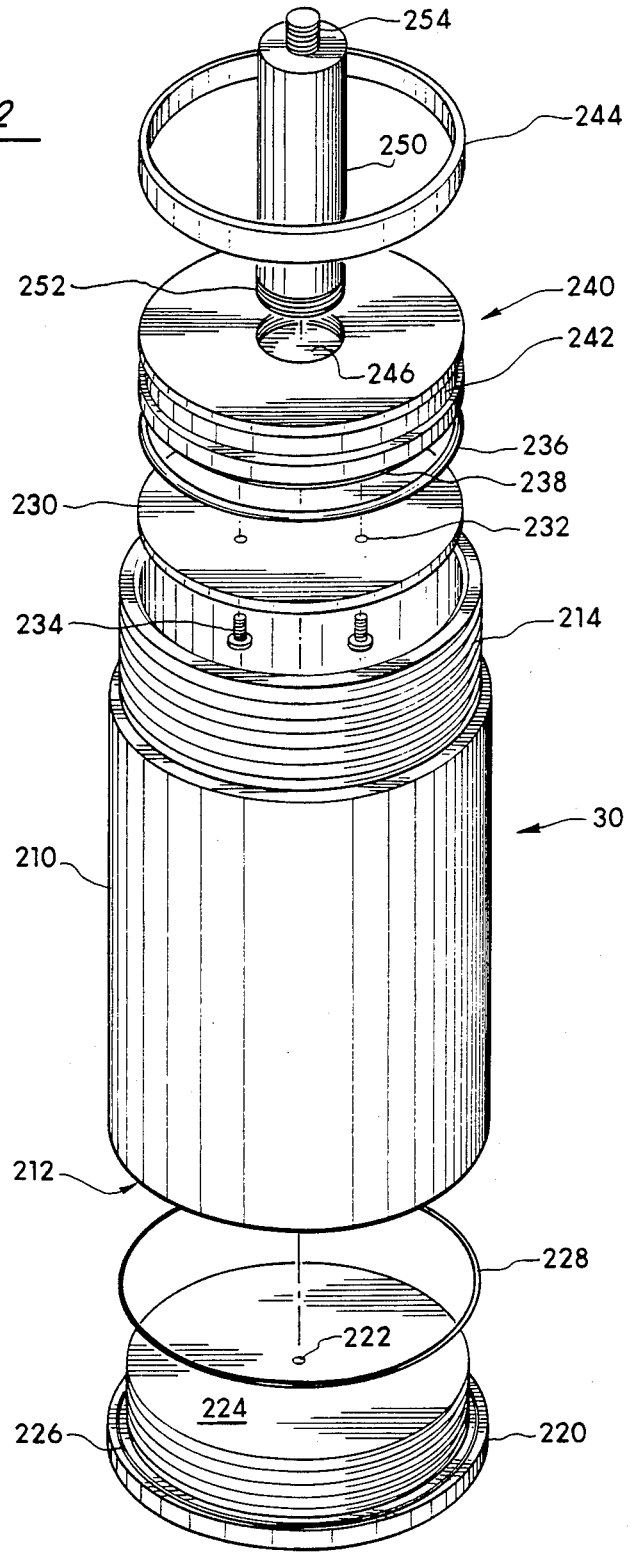
FIG. 2 is an exploded perspective view showing the assembly of the components for the booster piston of the present invention.
Figure 3:
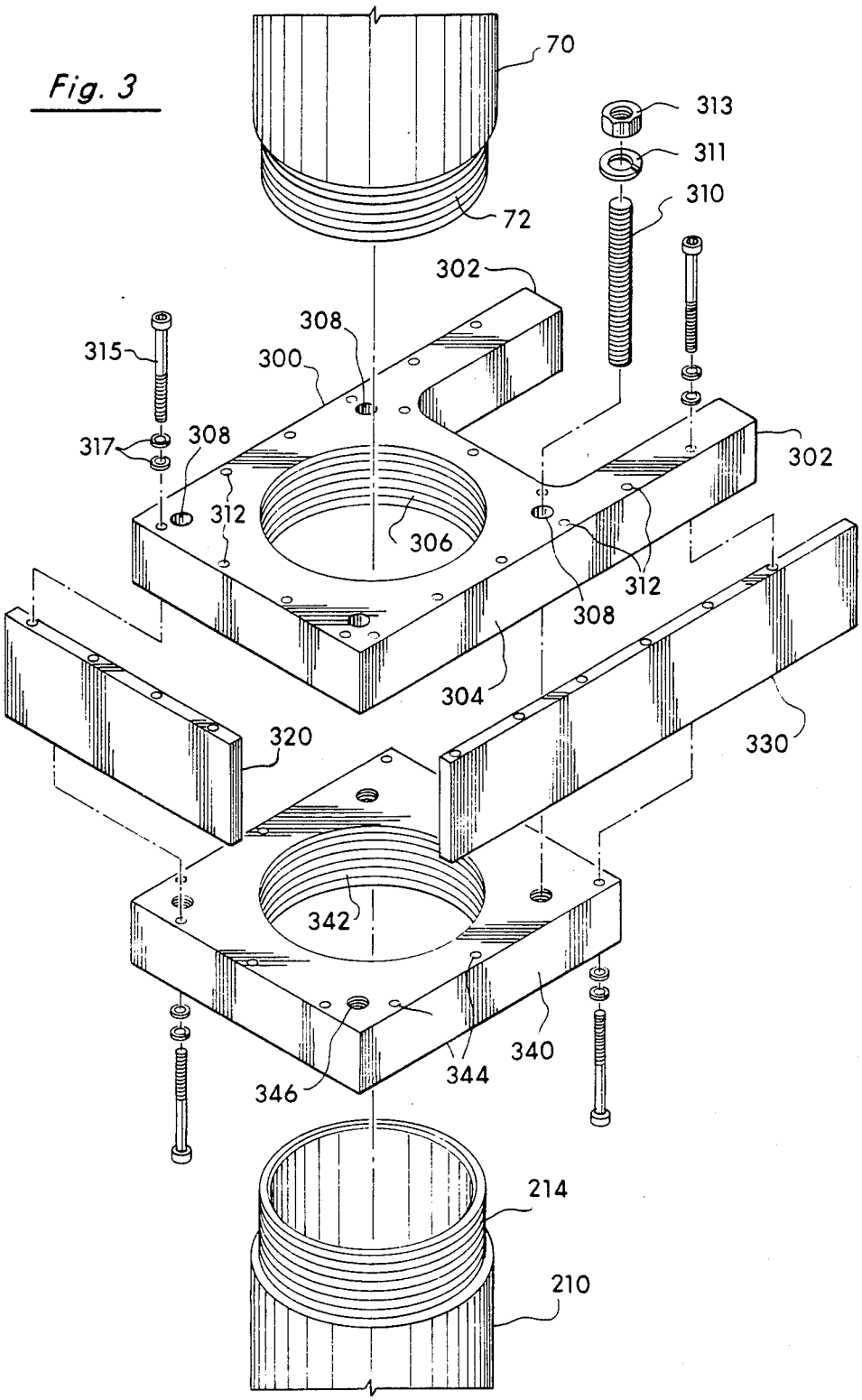
FIG. 3 is an exploded perspective view of the components showing the mounting plates and blocks connecting the pump to the booster piston of the present invention.

2. Pump Assembly 70—Pump assembly 70 is a conventional pump which uses a ball screw 40 driven by a motor 60 for driving piston 32 in cylinder 22 to provide a pressurized output through port 28. In the preferred embodiment, the present invention uses a conventional pump available from C o r e Research, Division of Western Atlas International, Inc., 1500 Salado Drive, Mountain View, CA 94043. This pump is modified as shown in FIGS. 1, 2, and 3 to be interconnected with the booster piston 30 of the present invention. Pump 70 couples the linear motion of ball screw 40 as shown by arrow 34 to produce the linear motion for piston 32 as shown by arrow 36.

3. Booster Piston 30—The booster piston assembly 30 is shown in FIGS. 1 and 2. The booster piston assembly 30 has a cylindrically shaped housing 210 and a cylinder cap 220. The cylinder cap 220 is machined from aluminum alloy and has a formed port 222 centrally oriented therein. The cylinder cap terminates in a cylindrical threaded region 224 and it has an O-ring groove 226 for receiving an O-ring 228. The booster cylinder 210 has a formed annular threaded region 212 for receiving the threaded portion 224 of the cylinder cap 220. The gas booster cylinder 210 is also machined from aluminum alloy material having an eight inch outer diameter in the preferred embodiment. The opposite end 214 of the booster cylinder 210 is threaded.

The booster piston assembly 30 comprises a seal retaining plate 230, a piston head 240, and the piston rod 250. A chamber 410 is formed between piston head 240 and cylinder cap 220 which contains a fluid at a predetermined pressure as will be discussed later.

The seal retaining plate 230 is made from thin aluminum alloy material being formed in the shape of a thin disk with four preformed holes 232 to receive screws 234 as shown in FIGS. 1 and 2. The screws 234 engage corresponding formed holes in the piston head 240. A BAL seal 236 fits over the end 238 of the piston head 240 and when the seal retaining plate 230 is firmly attached to the piston head 240, the BAL seal 236 is firmly held in place to provide a fluid seal between the piston head 240 and the inner surface of the piston sleeve 210. Also formed around the outer periphery of the piston head 240 is a second annular ring 242 which receives a TEFLON bearing 244. Bearing 244 functions to take up stresses that result from side loads, so that the BAL seal 236 will not be prematurely worn out. On the opposing end of the piston head 240 is a threaded centrally located annular cavity 246 which receives a threaded end 252 of the piston rod 250. The opposing end of the piston rod 250 terminates in a centrally located upstanding threaded bolt 254.

Port 222 located in cap 220 provides a fluid passageway for interconnection to the booster piston of a companion pump as will be subsequently discussed.

The booster piston 30 functions to provide a substantial upward force for the upper piston 32 when the upper piston 32 is being driven upwardly or downwardly.

4. Mounting Plate Assembly—In FIG. 3, the mounting plate 300 is shown to be rectangular in shape having two forked ends 302. Centrally located in the main body portion 304 is a formed threaded circular region 306 which receives the threaded end 72 of the pump 70. A plurality of bolt holes 308 (in the preferred embodiment four bolt holes) are formed around the cylindrical cavity 306 and receive bolts 310 with washers 311 and 313. In addition, a number of narrow bolt holes 312 are formed around the outer periphery of the main body portion 304 as shown in FIG. 3. These holes 212 go all the way through the mounting plate 300 so that bolts 315 with washers 317 may be inserted therethrough to firmly attach mounting plates 320 and 330 to the mounting plate 300. In FIG. 3, two of the four cover plates 320 and 330 engaging mounting plate 300 are shown. The booster cylinder mounting plate 340 is of rectangular construction and has a threaded central cavity 342 which receives the threaded end 214 of the booster cylinder sleeve 210 as shown in FIGS. 1 and 2. Likewise, holes 344 are formed through the cylinder mounting plate 340 to engage the edges of cover plates 320 and 330. Also formed in the booster cylinder mounting plate 340 are a plurality of threaded bolt holes 346 which receive the ends of bolts 310 to firmly hold the assemblage together as shown in FIG. 1. In this fashion, the pump 70 and the booster piston 30 are firmly mounted to the central mounting plates 300 and 340. Contained within the mounting plate assembly is the ball screw and nut assembly 40 which is discussed next.

5. Ball Nut and Screw Assembly 40—In FIG. 1, the ball nut and screw assembly 40 of the present invention is shown. The ball and nut screw assembly 40 connects the upper drive piston 32 to the booster piston rod 250. The ball screw 42 interconnects with the threaded end 254 of rod 250. The ball screw 42 is driven by a ball nut 44 which is conventionally keyed to spur gear 46. In a conventional fashion, spur gear 46 rotates being driven by gear 48. As spur gear 46 rotates so does ball nut 44 which drives ball screw 42 axially in the direction of arrow 34.

As shown in FIG. 1, the ball screw 42 cooperates with the upper piston 32 and the booster piston rod 250 under control of the stepper motor 60 in a manner to be discussed next. It is to be understood that while a ball screw is disclosed other screw assemblies such as an ACME threaded screw could also be used because of the reduced load on the races (or threads) as will be subsequently discussed.

6. Gear Reducer 50 and Stepper Motor 60 Assembly—The power assembly is composed of stepper motor 60 and a gear reducer assembly 50 as shown in FIG. 1. It is to be expressly understood, however, that any conventional power source that transmits torque to gear 48 of FIG. 1 may be utilized under the teachings of the present invention. The preferred embodiment of the present invention utilizes a conventional stepper motor 60 such as Model M106-178, Code H-B, manufactured by Compumotor, 1179 N. McDowell Blvd., Petaluma, Calif. 94952. The motor develops a maximum horsepower of 0.14 and a maximum torque of 700 oz.-inch. It has a maximum running horsepower of 0.07 at 120 rpm.

The stepper motor 60 is conventionally interconnected through a flex coupling 52 such as Model No. H/C MC7C200-24-20 manufactured by Helical Products Co., Inc., P.O. Box 1069, Santa Maria, Calif. 93456. The flex coupling 52 is in turn interconnected to a gear reducer 54 which is manufactured by Advanced Energy Technology, 839 Pearl Street, Box 4544, Boulder, Colo. 80306 as Model No. AET No. 100-I-H/T. The gear reducer 54 is then interconnected through means of a key 56 to spur gear 48. A housing 58 is formed around the gear reducer 54 to support the motor 60 in a conventional fashion.

The purpose of the stepper motor 60 is to provide the power to drive the piston 32 in the direction of arrow 36 to provide high pressure fluid displacement through port 28 with the assistance of the pressure in the booster piston 30.

7. System Operation—The hybrid fluid pump 10 of the present invention operates to provide a high pressure fluid output such as gas or liquid through port 28. The pump 70 is driven by a small powered motor 60 since the primary motive power is delivered from the intensifier or booster piston of the present invention.

Figure 4:
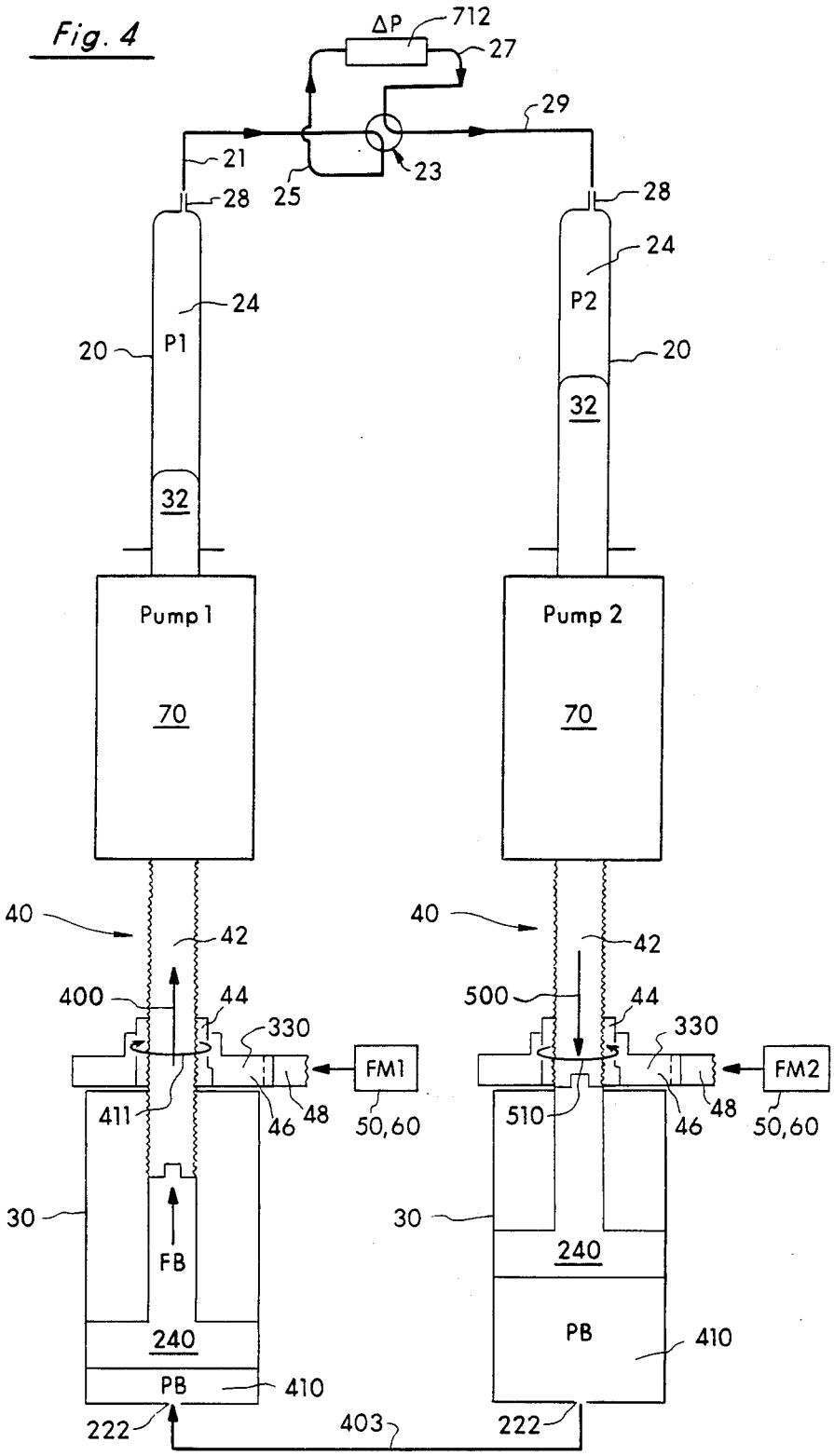
FIG. 4 is an illustration showing the interaction of two hybrid pumps of the present invention.

The present invention, as shown in the two pump environment of FIG. 4, overcomes the requirement for two expensive and powerful motors through use of the stress intensification created by the booster piston assembly 30 on the axis of the ball screw 42 for each pump. The booster piston assembly 30 supplies the majority of the motive force 400 required to drive piston 32 in pump upward to generate the high pressure displacement P1 through port 28. As shown in FIG. 4, the area of the piston 240 is approximately ten times larger than the piston 32. Hence, when a constant gas pressure of 700 psi exists in the booster chamber (410), termed pressure PB, the equilibrium pressure P1 (if there were no friction in the system) in the chamber 24 of the upper cylinder 20 would be 7000 psi. Hence, at any given time, the force on the high pressure piston from P1 can be nearly balanced by the pneumatic pressure PB on booster piston 240 if PB is 1/10 the value of P1. One significant effect is on the ball screw 42, whereby the countervailing forces result in a lower stress on the balls and ball races of the ball screw than conventionally found thereby providing a significantly longer life.

In such high pressure environments, the stroke of the upper piston 32 and the lower piston 240 occurs approximately once a minute in preferred operation.

In principle, pressure PB in chamber 410 could be adjusted to balance the pressure P1, which is delivered to the upstream end of an element such as a core sample 712 being tested, or to balance the downstream pressure P2 at the effluent end of the sample 712 or to some pressure in between. However, in practice, it is best to balance to the downstream pressure P2. In this situation, the motive force, FM1, from the motor 60 need overcome only the differential pressure, $\Delta P = P1 - P2$, multiplied by the cross-sectional area of the drive piston 32 plus the frictional forces in pump 1 (i.e., the friction in the pressure seals, in the ball screw and gears and bearings, in the motor reducer transmission and in the motor, itself) when the drive piston 32 is advancing in the direction of arrow 400 and displacing fluid into the core sample 712. The booster motive force from the booster piston assembly 30 provides the remaining force which is the cross sectional area of piston 240 multiplied by the predetermined low pressure PB.

In a preferred embodiment, a fluid-recirculating mode of operation, at least two hybrid pump assemblies as described above are required and shown in FIG. 4. While pump 1 is delivering fluid through line 21, through four-way valve 23, and through line 25 to core sample 712, pump 2 is receiving nearly the same mass rate of fluid flow from the core sample 712 through line 27, through four-way valve 23, through line 29, and into port 28. Hence, this second hybrid pump assembly is being filled with high pressure gas at pressure P2 while pump 1 is delivering high pressure gas at pressure P1. The low pressure pneumatic booster cylinders are connected together by line 403, so that when pump 2 is retreating in the direction of arrow 500, the low pressure booster gas is displaced from its booster chamber 410 into the booster chamber 410 of pump 1. Thus, during the time that pump 2 is retreating, its motor needs only to supply enough motive force, FM2, to overcome frictional forces, only. The force from pressure P2 is exactly balanced by the force from pressure PB. Because pump 1 advances at nearly the same volumetric rate that pump 2 retreats, the booster pressure PB remains nearly constant with time.

8. Gas/Liquid Permeameter System—In FIG. 5, a gas/liquid permeameter system based upon the hybrid high pressure pumps of the present invention is set forth. A core plug holder 700 is disclosed containing a core sample 702. High pressure gas is delivered over line 704 and high pressure liquid is delivered over line 706. The combined high pressure gas and liquid is delivered from the core sample 702 over line 708 into a gas-liquid separator 710. A pressure sensor 712 measures the pressure drop across the core sample 702. As stated, incoming pressures for the gas and the liquid are in the order of 7000 psig, the outgoing pressure in line 708 is 6950 psig and a differential pressure of 50 psig is measured by pressure transducer 712. It is to be expressly understood that other high pressure values could be used in accordance with the teachings of the present invention.

Figure 5:
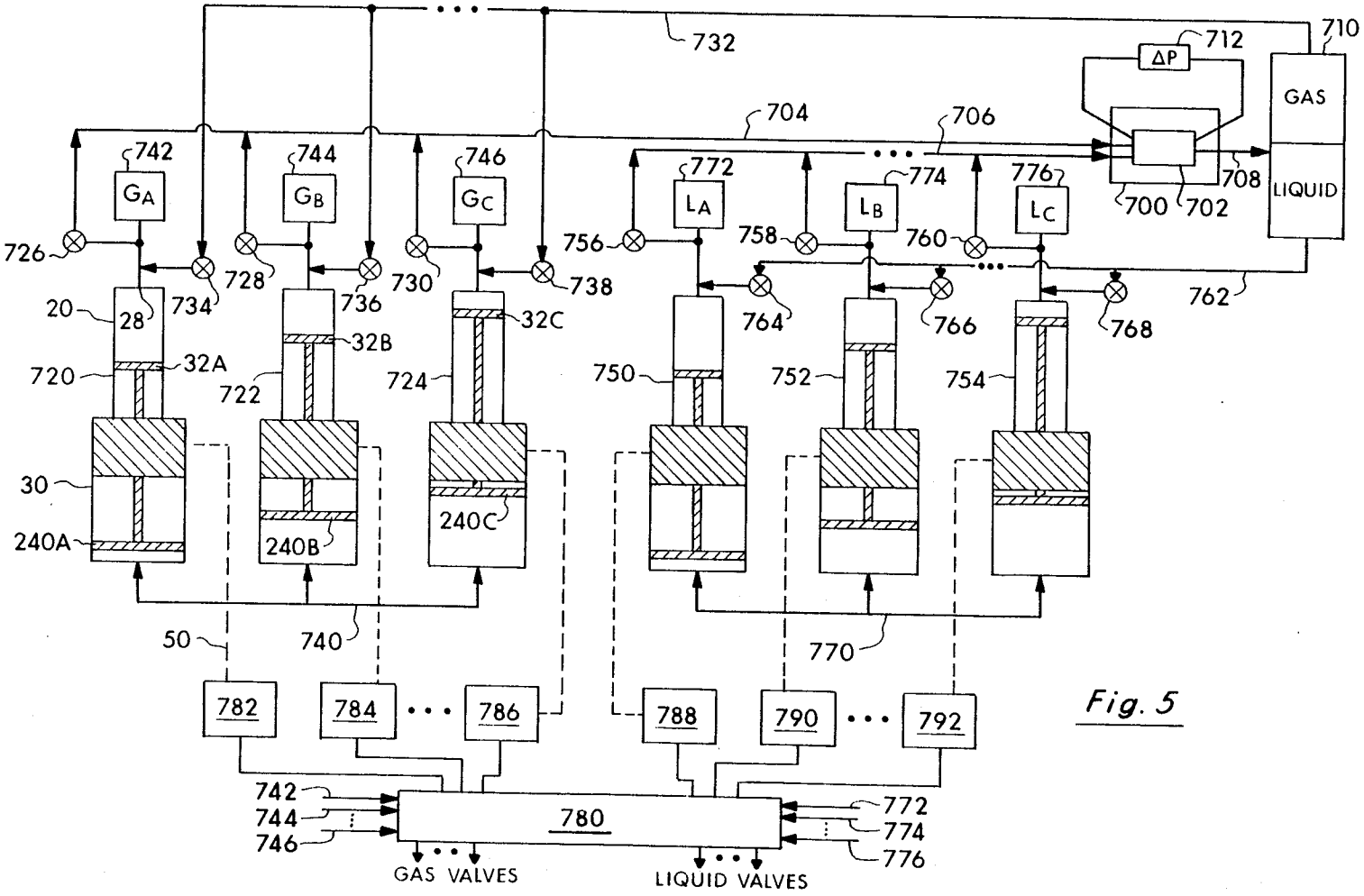
FIG. 5 is a block diagram illustration showing a gas/-liquid permeameter system.

In FIG. 5, three high pressure hybrid pumps 720, 722, and 724 deliver the high pressure gas over line 704 to the core sample 702. Between each pump 720, 722, and 724 and line 704 is a valve 726, 728, and 730. Likewise, between each pump 720, 722, and 724, and the gas return line 732 is a return valve 734, 736, and 738. The chambers of the booster pistons of pumps 720, 722, and 724 are interconnected over a common line 740 through ports 222. Pressure transducers 742, 744, and 746 accurately measure the pressure delivered by pumps 720, 722, and 724 respectively.

There is a set of three hybrid pumps 750, 752, and 754 for delivery of the high pressure liquid over line 706 to the core sample 702. Between line 706 and each of the pumps 750, 752, and 754, is a set of three valves 756, 758, and 760. Between the liquid return line 762 and each of the three pumps 750, 752, and 754, is a set of three valves 764, 766, and 768. Likewise, a common line 770 interconnects each of the booster pistons of pump 750, 752, and 754 together. Pressure transducers 772, 774, and 776 measure the pressures of the liquid delivered by pumps 750, 752, and 754, respectively.

Figure 6:
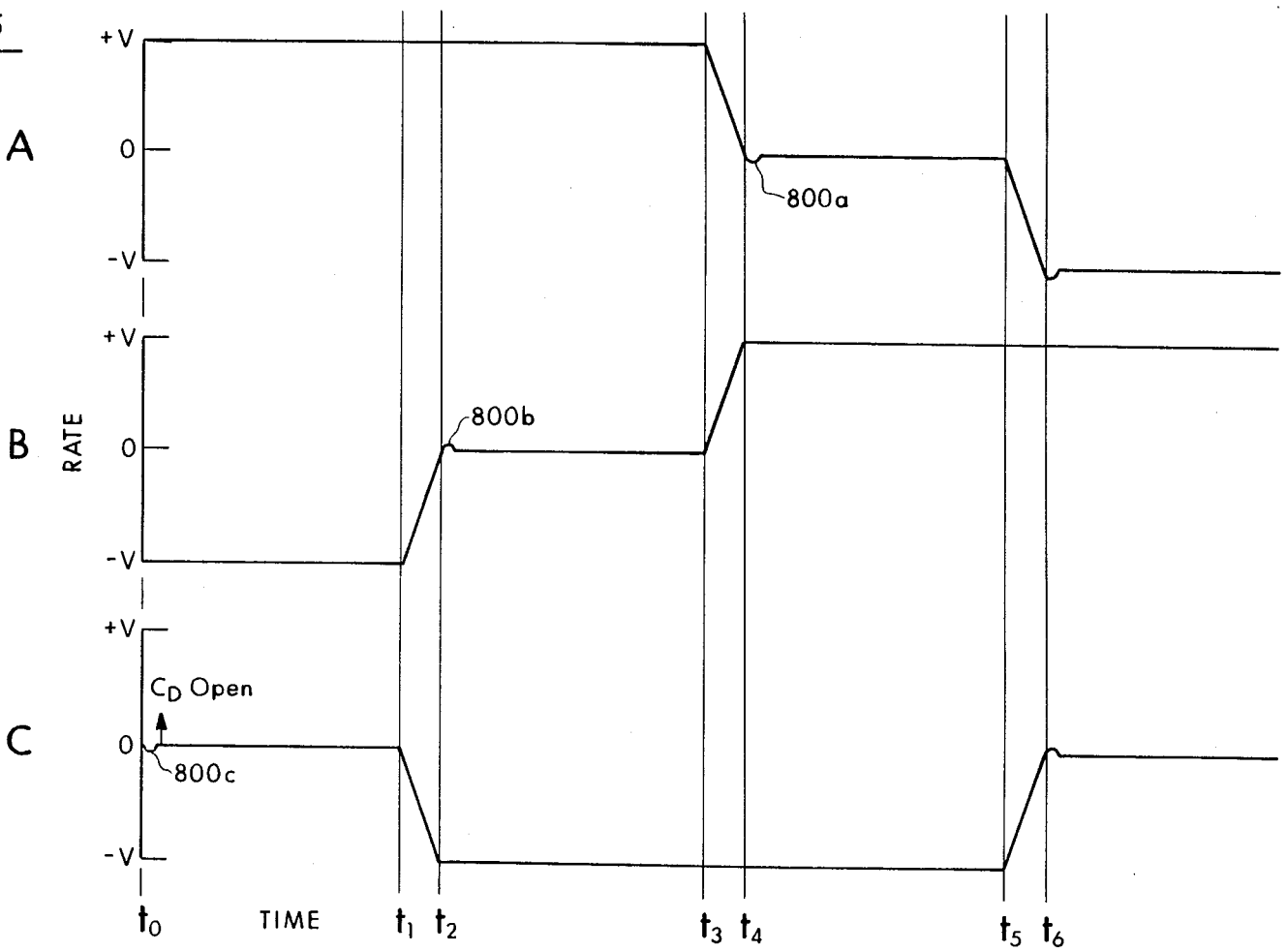
FIG. 6 is a graph showing the rate of movement of the gas delivery pistons in the system of FIG. 5.

Also associated with the system shown in FIG. 6 is a computer 780 controlling stepper motors 782, 784, 786, 788, 790, and 792. Each motor is selectively interconnected with its respective hybrid pump as previously discussed. The computer 780 receives gas pressures from pressure transducers 742, 744, and 746 and liquid pressures from transducers 772, 774, and 776. The computer 780 further controls the gas delivery valves 726, 728, and 730 and the gas return valves 734, 736, and 738. Likewise, the computer 780 controls the opening and closing of the liquid delivery valves 756, 758, and 760 and the opening and closing of the return liquid valves 764, 766, and 768.

Essentially, the three hybrid gas pumps 720, 722, and 724 continuously deliver high pressure gas through line 704 to the core sample 702. During this delivery of high pressure gas, the booster piston of each of the pumps is at a constant pressure since line 740 interconnects each of the chambers of the booster pistons together. In the preferred embodiment, line 704 would have a delivery pressure of 7000 psig and line 732 would have a receiving pressure of 6950 psig (the differential pressure being 50 psig). The pressure in line 740 and in each booster chamber is set to 695 psig since the area of the booster piston in the preferred embodiment is ten times greater than the area of the delivery piston. As will be set forth in the following, stepper motors 782, 784, and 786 only provide sufficient motive power to overcome the friction of the hybrid pump system and the differential pressure across the permeameter system caused by the flow lines, the valves, and the core sample 702.

The system shown in FIG. 5 is a generalized system essentially showing the use of two or more pumps for the delivery of the gas and two or more pumps for the delivery of the liquid. The use of a number of pumps greater than two provides more continuous flow of the high pressure aas through the core sample 702.

In FIG. 6, the operation of the system in FIG. 5 is shown. FIG. 6 is a graphical illustration of the rate of movement of the pistons 32 for each of the pumps 720, 722, and 724 for constant rate mode of operation. For example, in FIG. 6, for hybrid pump 720, graph A shows piston 32A moving in a positive direction upwardly at a constant rate or velocity, V, from time t0 through time t3. At time t3, piston 32A approaches the top end of the cylinder and commences to slow down until it reaches zero velocity at time t4. During the time interval t0 through t3 high pressure fluid at 7000 psig (however, this pressure may not be constant with time) is being delivered through the open valve 726 through line 704 and through the core sample 702. During that time interval, valve 734 which is the return from line 732 is closed. Transducer 742 measures the pressure of the gas, GA, being delivered. During time interval t0 through t3, the corresponding booster piston 240A is moving upwardly in te booster cylinder. The pressure on the booster piston is constant and is always at 695 psig. Hence, the motor 782 delivering the movement to the piston 32A need only be sufficiently powerful to overcome frictional forces in the pump, and the afore-discussed differential pressure of the system including the differential pressure measured by transducer 712 across the core sample 702.

During time interval t0 through t1 hybrid pump 722 as shown by graph B of FIG. 6 is moving downwardly at a negative constant velocity or rate, −V. It is to be noted that during time interval t0 to t1, pump 720 is delivering the high pressure gas in the delivery line 704 while pump 722 is receiving the high pressure gas from the return line 732. Because the return gas is at a lower pressure than the delivered gas, pump 722 must move at a slightly higher rate than pump 720. At time t1, the piston 32B approaches the bottom of the stroke and commences to slow down to zero velocity. During time interval t0 through t2, valve 728 is closed and valve 736 is open so that the high pressure gas in line 732 (i.e., 6950 psig) is being delivered through open valve 736 and into the chamber above piston 32B. Hence, during this time interval, stepper motor 784 need only provide sufficient power to overcome frictional forces in the pump assembly keeping in mind it is driving against nearly constant 695 psig (equivalency of 6950 psig) booster chamber below piston 240B. When the velocity of piston 32B reaches zero, the computer 780 closes valve 736. A slight upward movement is shown in FIG. 6 as hump **800*b*. This movement for piston 32B to go up slightly and then slow down and stop is required to compress the gas contained above piston 32B which was initially at 6950 psig, to a pressure equal to the currently delivering pump, 720, or about 7000 psig. After this compression is completed (i.e., after the bump 800*b* stops), the computer 780 then opens valve 728 so that hybrid pump 722 is in position for the drive cycle. However, as shown in FIG. 6, hybrid pump 722 stays at zero velocity until time t3. Hybrid pump 724 during time interval t0 through t1 is at the upper portion of the drive stroke and is not moving. Valves 730 and 738 are closed by the computer 780. However, as a result of the "downward hump", 800*c*, which serves a similar function to 800*b*, the pressure above pump 724 is reduced from the delivery pressure, 7000 psig, to the receiving pressure, 6950 psig, after which valve 738 is opened. Then stepper motor 786 is not active. At time t1, piston 32C is driven downwardly by stepper motor 786 constantly accelerating until it reaches a constant rate at time t2 which it maintains until time t5. Again, it 15 is to be noted that during time interval t2 to t3, pump 720 is delivering high pressure gas in the delivery line 704 while at the same time, pump 724 is receiving high pressure gas in the return line 732. Furthermore, during the transition time interval from t1 to t2, pumps 722 and 724 both have a negative rate, which when added together slightly exceeds the positive rate of pump 720**.

Hence, during the delivery of high pressure gas through line 704, the delivery takes place from time t0 throug time t3 by means of hybrid pump 720. During the first half of this cycle, hybrid pump 722 receives the return gas through line 732 and during the second half of the t0, t3 cycle, hybrid pump 724 receives the remaining return pressure over line 732.

It is to be expressly understood that the system is under control of the computer 780 and that two or more hybrid pumps can be utilized for the delivery of the gas or the liquid to the core sample 702. The use of more than two hybrid pumps for the delivery of the liquid or the gas results in a system as shown in FIG. 5 that continuously delivers and receives the gas or the liquid from the core sample 702.

Most importantly, it is seen that each of the stepper motors 782 through 792 need only be powerful enough to overcome friction plus the differential pressure of the system due to the maintenance of a constant booster pressure in line 740 beneath the booster pistons.

While the preferred embodiment has been set forth with a degree of particularity, it is to be understood that changes and modifications could be made to the construction thereof which would still fall within the teachings of the claimed invention as set forth in the following claims.

I claim:

1. A hybrid fluid pump (10) for delivering a high pressure fluid in a fluidsystem, said hybrid fluid pump comprising an upper drive cylinder (22), an upper drive piston (32) disposed in said upper drive cylinder, said upper drive cylinder having a formed port (28) through which said high pressure fluid is delivered, an upper chamber (24) formed above said drive piston and in said upper drive cylinder for carrying said high pressure fluid, a screw (40), means connected to one end of said screw for coupling to said upper drive piston to move said upper drive piston in said upper drive cylinder thereby displacing said high pressure fluid in said upper chamber to a desired output pressure (P1) for displacement through port (28), driving means (46, 48) coupled to said screw for axially driving said screw, a booster cylinder (210), a booster piston (240) disposed in said booster cylinder and connected to the opposing end of said screw, the area of said booster piston area being at least an order of magnitude greater in size than the area of said upper drive piston, a booster chamber (410) formed under said booster piston and in said booster cylinder and means for maintaining a predetermined constant intensifying pressure (PB), said predetermined constant intensifying pressure providing a booster motive force (FB) on said screw in the direction of moving said drive piston into said upper dive cylinder in order to displace high pressure fluid from said upper chamber, and a stepper motor and reducer (50,60) connected to said driving means for delivering additional motive force (FM1) to axially move said screw in a drive stroke to displace said high pressure fluid in said upper chamber, said additiional motive force (FM1) being equal to the differential pressure of said system multiplied by the cross sectional area of said upper drive piston plus the frictional forces present in said hybrid pump but less than said booster motive force, said stepper motor being capable of moving said screw in a return stroke.

2. A system having at least two hybrid fluid pumps (10) for delivering and receiving a high pressure fluid output to and from an element (712) within said system, said system comprising, each of said hybrid fluid pumps comprising:

an upper drive cylinder (22), an upper drive piston (32) disposed in said upper drive cylinder, said upper drive piston having a formed port (28) through which said high pressure fluid is delivered and received, an upper chamber (24) formed above said drive piston and in said upper drive cylinder for carrying said high pressure fluid, a screw (42), means (44) connected to one end of said screw for coupling to said upper drive piston in order to move said upper drive piston in said upper drive cylinder thereby displacing said high pressure fluid in said upper chamber to a desired output pressure (P1) for displacement through said formed port, driving means (46,48) engaging said coupling means for axially driving said screw, a booster cylinder (210), a booster piston (240) disposed in said booster cylinder and connected to the opposing end of said screw, a booster chamber (410) formed under said booster piston and in said booster cylinder for carrying a fluid having predetermined constant intensifying pressure (PB), said predetermined constant intensifying pressure providing a booster motive force (FB) on said screw in the direction of moving said drive piston into drive cylinder in order to displace said high pressure fluid in said upper chamber, and delivering means (50,60) connected to said engaging means for delivering additional motive force (FM1) to axially move said screw in a drive stroke to displace said high pressure fluid in said upper chamber, said additional motive force (FM1) being equal to the differential pressure of said system across said element multiplied by the cross sectional area of said upper drive piston plus the frictional forces present in said hybrid pump but less than said booster motive force, said delivering means being capable of moving said screw in a return stroke to displace said fluid in said booster chamber, means for connecting said port (28) of said upper drive piston (32) of one of said pumps to one side of said element in order to delivery said fluid at a predetermiend pressure (P1) into said element, means for connecting said port (28) of said upper drive piston (32) of the remaining of said pumps to the other side of said element in order to receive fluid at a predetermined pressure (P2) from said element, and means for connecting said booster chambers in fluid communication in order to maintain said intensifying pressure (PB) approximately constant during said delivery and receipt of said fluid to and from said element.

3. The hybrid pumps of claim 2 wherein the area of said booster piston is greater than the area of said upper drive piston so that the pressure in said booster chamber is less than the pressure in said upper chamber.

4. The hybrid pumps of claim 3 wherein said booster piston area is at least an order of magnitude greater in size than said upper drive piston area so that said booster chamber pressure is an order of magnitude less than said upper chamber pressure.

5. A system having at least two hybrid fluid pumps (10) for delivering a high pressure fluid output to and from an element (712) within said system, said system comprising:

each of said hybrid fluid pumps comprising:

a drive piston assembly (20), said drive piston assembly having a formed port (28) through which said high pressure fluid output is delivered and received, said drive piston assembly having a driving stroke for compressing and displacing said high pressure fluid at a desired output pressure (P1) for delivery of said fluid to said element and a return stroke for receiving said fluid from said element, a screw (42), coupling means (44) connected to one end of said screw for coupling to said drive piston in order to drive said drive piston assembly in said drive stroke thereby displacing said high pressure fluid at said desired output pressure (P1) through said formed port, driving means (46, 48) engaging said coupling means for axially driving said screw, a booster piston assembly (30) connected to the opposing end of said screw, said booster piston assembly having a driving stroke and a return stroke for maintaining a predetermined approximately constant intensifying pressure (PB), said predetermined constant intensifying pressure providing a booster motive force (FB) on said screw in the direction of said driving stroke of said drive piston during both the driving stroke and the return stroke of said booster piston assembly, and means (50, 60) connected to said engaging means for delivering additional motive force (FM1) to axially move said screw in order to assist said driving stroke of said upper drive piston, said additional motive force (FM1) being greater than the frictional forces present said hybrid pump but less than said booster motive force, means (21, 23, 25) for selectively connecting said port (28) of said upper drive piston (32) of one of said pumps during its drive cycle to one side of said element in order to deliver said fluid at a predetermined pressure (P1) into said element, means (27, 23, 29) for selectively connecting said port (28) of said upper drive piston (32) of the remaining pump during its return cycle to the other side of said element in order to receive fluid at a predetermined pressure (P2) from said element, and means (403) for connecting said booster chambers (402, 410) in fluid communication in order to maintain said intensifying pressure (PB) constant during said delivery and receipt of said fluid to and from said element.

6. The hybrid pump of claim 5 in which said drive piston assembly comprises a piston (32), said booster piston assembly comprises a piston (240) and wherein the area of said booster piston is greater than the area of said drive piston so that said booster pressure is less than said high pressure.

7. The hybrid pump of claim 6 wherein said booster piston area is at least an order of magnitude greater in size than said upper drive piston area.

8. A hybrid fluid pump (10) for delivering fluid at a predetermined high pressure, said hybrid fluid pump comprising:

a high pressure piston assembly (20) comprising:

(a) a high pressure cylinder (22), (b) a high pressure piston (32) disposed in said high pressure cylinder, (c) a high pressure chamber (24) formed between said high pressure cylinder and said high pressure piston containing said fluid, and (d) fluid outlet means (28) in said cylinder connecting with the high pressure chamber for delivering said fluid from said high pressure chamber, said high pressure piston assembly having a driving stroke for displacing said fluid in said high pressure chamber at said predetermined high pressure through said fluid outlet delivering means and a return stroke, a low pressure piston assembly (30) comprising:

(a) a low pessure cylinder (210), (b) a low pressure imperforate piston (240) disposed in said low pressure oylinder, the area of said low pressure piston being at least an order of magnitude greater than the area of said high pressure piston, (c) a low pressure chamber (410) formed between said low pressure cylinder and said low pressure piston, and (d) a gas disposed in said low pressure chamber, said low pressure piston assembly having a driving stroke for displacing said gas in said low pressure chamber at a predetermined constant low pressure (PB) and a return stroke, said predetermined constant low pressure being at least an order of magnitude less than said predetermined high pressure, said low pressure piston providing an upward force on said high pressure piston equal to said predetermined constant low pressure multiplied by the cross sectional area of said low pressure piston, connecting means (70) for connecting said high pressure piston to said low pressure piston so that when said high pressure piston is in its driving stroke said low pressure piston is in its returnstroke and when said high pressure piston is in its return stroke said low pressure piston is in its driving stroke, and mechanical driving means (50,60) coupled to said connecting means, said high pressure piston assembly and to said low pressure piston assembly for assisting the low pressure piston in driving said high pressure piston in its driving stroke, the motive force (FM) from said mechanical driving means being independentof the force produced by the low pressure piston and being equal to the difference between the force on the high pressure piston and the force on the low pressure piston multiplied by the cross sectional area of said high pressure piston plus the frictional forces present is said hybrid pump.

9. A hybrid pump, high pressure fluid permeameter for measuring the relative permeability of core sample (712), said permeameter comprising:

a core holder (700) for holding said core sample, a high pressure fluid delivery line (704) connected to the input of said core holder (700), a high pressure fluid return line (732) connected to said output of said core holder, at least two hybrid high pressure fluid pumps (720, 722) connected to said fluid delivery line and to said fluid return line, each of said hybrid high pressure gas pumps comprising:

(a) a drive piston assembly (20), said drive piston assembly having a formed port (28) through which said high pressure fluid is delivered into said fluid delivery line and is received from said fluid return line and a drive piston (32), said drive piston assembly having a driving stroke for displacing said high pressure fluid through said formed port and a return stroke, driving means (50) connected to said piston assembly for driving said drive piston in said drive stroke, (c) a booster piston assembly (30) connected to said driving means, said booster piston assembly having a drive stroke and a return stroke for maintaining a predetermined constant intensifying pressure, said predetermined constant intensifying pressure providing a booster motive force on said driving means in the direction of said driving stroke of said drive piston during both the driving stroke and the return stroke of said booster piston assembly, and (d) delivering means (782) connected to said driving means for delivering additional motive force to assist said driving stroke of said drive piston, said additional motive force being greater than the frictional forces present in said hybrid pump plus the differential pressure of said permeameter multiplied by the cross sectional area of said drive piston but less than said booster motive force, said delivering means being capable of moving said driving means in the direction of said driving stroke of said booster piston during the return stroke of said drive piston assembly, means (740) connected to each of said booster piston assemblies in said at least two hybrid high pressure fluid pumps for providing fluid communication in order to maintain said predetermined constant intensifying pressure in each of said booster piston assemblies, and means (780) coupled to said delivering means of each of said hybrid pumps for causing at least one of said pumps to move in a direction to produce high pressure fluid in said delivery line while causing at least one of said remaining pumps to move in a direction to receive high pressure fluid from said return line.

10. A high pressure fluid permeameter for measuring the permeability of a core sample (712), said permeameter comprising:

a core holder (700) for holding said core sample, a high pressure fluid delivery line (704) connected to the input of said core holder, a high pressure fluid return line (732) connected to said output of said core holder, at least two high pressure fluid pumps (720, 722) connected to said fluid delivery line and to said fluid return line, each of said high pressure gas pumps comprising:

(a) a drive piston assembly (20), said drive piston assembly having a formed port (28) through which said high pressure fluid is delivered into said fluid delivery line and is received from said fluid return line and a drive piston (32), (b) driving means (50) connected to said piston assembly for driving said piston assembly in a drive stroke, (c) a booster piston assembly (30) connected to said driving means, said booster piston assembly having a drive stroke and a return stroke for maintaining a predetermined constant intensifying pressure, said predetermined constant intensifying pressure providing a booster motive force on said driving means in the direction of said driving stroke of said drive piston during the return stroke of said booster piston assembly, and (d) delivering means (782) connected to said driving means for delivering additional motive force to assist said driving stroke of said drive piston, said delivering means being capable of moving said driving means in the direction of said driving stroke of said booster piston during the return stroke of said drive piston assembly, means connected to each of said booster piston assemblies in said at least two hybrid high pressure fluid pumps for providing fluid communication in order to maintain said predetermined constant intensifying pressure in each of said booster assemblies, and means (780) coupled to said delivering means of each of said hybrid pumps for causing at least one of said pumps to move in a direction to produce high pressure fluid in said delivery line while causing at least one of said remaining pumps to move in a direction to receive high pressure fluid from said return line.

11. A high pressure fluid permeameter according to claim 9, including a high pressure liquid delivery line (706) connected to the input of said core holder (700), a high pressure liquid return line (762) connected to said output of said core holder, and at least two high pressure liquid pumps (750, 752) connected to said liquid delivery line and to said liquid return line.

12. A high pressure fluid permeameter according to claim 10, including a high pressure liquid delivery line (706) connected to the input of said core holder (700), a high pressure liquid return line (762) connected to said output of said core holder, and at least two high pressure liquid pumps (750, 752) connected to said liquid delivery line and to said liquid return line.

* * * * *

UNITED STATES PATENT AND TRADEMARK OFFICE

CERTIFICATE OF CORRECTION

PATENT NO. : 4,856,967

DATED : August 15, 1989

INVENTOR(S) : Stanley C. Jones

It is certified that error appears in the above-identified patent and that said Letters Patent is hereby corrected as shown below:

Title page, left column: After notation for inventor, add separate paragraph --[73] Assignee: Marathon Oil Company, Findlay, Ohio--.

Signed and Sealed this

Fourth Day of August, 1992

*Attest:*

*Attesting Officer*

DOUGLAS B. COMER

*Acting Commissioner of Patents and Trademarks*